US007562479B2

(12) United States Patent
Williams et al.

(10) Patent No.: US 7,562,479 B2
(45) Date of Patent: Jul. 21, 2009

(54) SET TRIGGER FOR A FIREARM

(76) Inventors: Denny Williams, 111 SE. Second St., Atwood, IL (US) 61913; Dick Abraham, 27 W. 990 Industrial Ave., Lake Barrington, IL (US) 60010

( * ) Notice: Subject to any disclaimer, the term of this patent is extended or adjusted under 35 U.S.C. 154(b) by 0 days.

(21) Appl. No.: 11/364,962

(22) Filed: Feb. 28, 2006

(65) Prior Publication Data

US 2009/0113777 A1 May 7, 2009

Related U.S. Application Data

(60) Provisional application No. 60/657,793, filed on Feb. 28, 2005.

(51) Int. Cl.
*F41A 19/16* (2006.01)
*F41A 19/17* (2006.01)

(52) U.S. Cl. ..... 42/69.03; 42/70.06

(58) Field of Classification Search ..... 42/41, 42/42.02, 42.03, 65, 66, 69.01, 69.02, 69.03, 42/70.01, 70.06, 70.07, 104, 106; 89/36.01, 89/36.02, 36.03, 36.04, 36.07, 36.08, 36.09, 89/36.12, 36.17; 428/188, 304.4, 313.3, 428/314.2, 321.5, 457, 911
See application file for complete search history.

(56) References Cited

U.S. PATENT DOCUMENTS 181,855 A * 9/1876 Leonard ..... 42/69.01
1,513,654 A * 10/1924 Thompson ..... 42/69.01
1,837,093 A * 12/1931 Andrews ..... 42/69.01
2,468,784 A * 5/1949 Seagraves ..... 89/185
2,558,872 A * 7/1951 Miller ..... 42/69.02
2,788,601 A * 4/1957 Hardgrave ..... 42/69.02
2,920,413 A * 1/1960 Marhefka et al. ..... 42/69.01
2,927,390 A * 3/1960 Lewis ..... 42/65
3,153,874 A * 10/1964 Merrill ..... 42/41
3,269,045 A * 8/1966 McGaughey ..... 42/65
RE27,568 E * 1/1973 Vadas et al. ..... 124/76
4,016,668 A * 4/1977 Frazier ..... 42/69.01
4,158,926 A * 6/1979 Kordas et al. ..... 42/69.01
4,199,886 A * 4/1980 Deuring ..... 42/44
4,411,087 A * 10/1983 Aikman ..... 42/69.02
4,499,684 A * 2/1985 Repa ..... 42/69.01
4,625,444 A * 12/1986 Beretta ..... 42/69.02
4,754,567 A * 7/1988 Lehfeldt et al. ..... 42/69.02
4,908,970 A * 3/1990 Bell ..... 42/69.02
5,560,134 A * 10/1996 Van Niekerk et al. ..... 42/70.06

* cited by examiner

*Primary Examiner*—Bret Hayes
(74) *Attorney, Agent, or Firm*—Faier & Faier P.C.; James Michael Faier; Martin Faier

(57) ABSTRACT

A set trigger assembly that enables a user of a firearm with a trigger, return spring plunger, and a return spring plunger spring to modify the trigger mechanism on-demand to reduce the trigger pressure required to fire the firearm by enabling the user to retract the return spring plunger and then return the return spring plunger to its initial position by insertion of a lever which is used to apply force to a return spring plunger so as to force the return spring plunger away from the trigger.

14 Claims, 4 Drawing Sheets

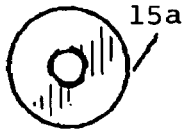
FIG. 6A
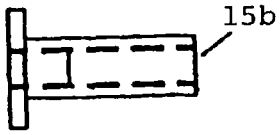
FIG. 6B
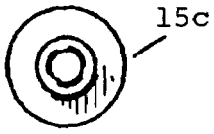
FIG. 6C
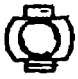
FIG. 7A
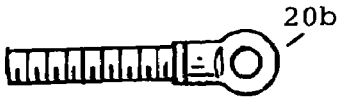
FIG. 7B
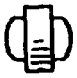
FIG. 7C
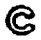
FIG. 8B
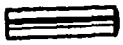
FIG. 8A
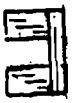
FIG. 9D
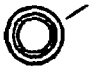
FIG. 10C
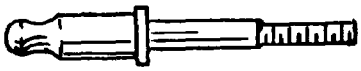
FIG.10B
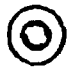
FIG.10A
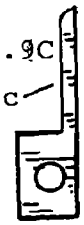
FIG.9C
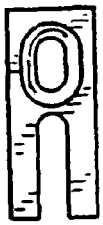
FIG. 9A
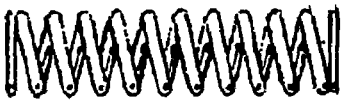
FIG.11A
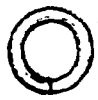
FIG.11B
FIG.9B
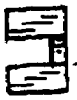
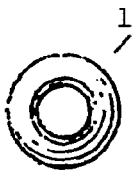
FIG.12A
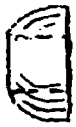
FIG.12B
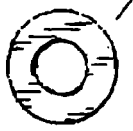
FIG.12C
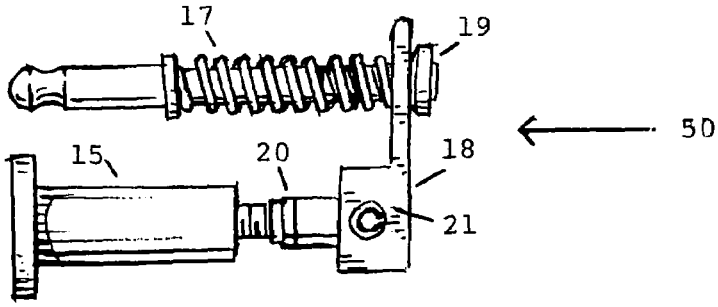
FIG.13

SET TRIGGER FOR A FIREARM

This application claims priority from U.S. Provisional Patent Application Ser. No. 60/657,793 filed 28 Feb. 2006. This invention relates to a set trigger for a firearm that is particularly useful in allowing target shooting and other shooting environments requiring great accuracy.

BACKGROUND AND SUMMARY OF THE INVENTION

Typically, a Fusil Automatique Leger rifle, commonly known as a FAL rifle, has a single trigger that cannot be adjusted. Typically, a FAL requires eight pounds to fifteen pounds of pressure on the trigger to fire the rifle. If the trigger is set with too much resistance, then a person firing the rifle would likely move the rifle in applying sufficient pressure to the trigger when firing the rifle. The result of inadvertent movement is that the person would shoot less accurately. This problem is particularly serious where accuracy is key such as in competition shooting and sniper shooting.

Conversely, if the trigger is adjusted such that resistance is at a minimum, then the rifle is likely to fire inadvertently. Such a trigger is often described as a "hair trigger." Definitions of a "hair trigger" differ. For persons who fire a weapon from a bench rest, a "hair trigger" may be considered a trigger that requires one to six ounces of pressure to fire a rifle. For persons carrying a rifle, a "hair trigger" would typically require less than two pounds to fire a rifle. A hair trigger is regarded as a safety hazard. Where one possesses a weapon with a hair trigger, the possessor must be very careful to avoid inadvertent discharge of the rifle.

Owners of FAL rifles have long sought a device that would allow the user of a FAL rifle to adjust the resistance on the trigger to a selected level of resistance at the time when the user fires the rifle. The rifle user could then maintain the resistance at a level that would provide assured safe carrying of the rifle and allow the user to lower the resistance just prior to firing so as to maximize accuracy. A trigger that would allow for variable pressure relief is all the more useful if a user could adjust the pressure to his or her desired level. Prior to this invention, the user had no method or device to achieve lower pressure. Some would try to grind or polish the engagement surface of the hammer and the sear nose but those techniques could adversely affect the operation of the firearm depending on the method and extent of the change to those components. Any steps taken in the field would not be practical and may be dangerous. With use of this invention one may reduce the pressure required from eight to fifteen pounds to as low as one and one-half pounds. Using the preferred embodiment, the trigger would typically require as little as two and one-half to three and one-half pounds of pressure. Pressures as low as one and one-half pounds have been achieved by employing the preferred embodiment.

The invention provides a solution to the problem of selectively reducing resistance on a trigger at the time the user wants to fire the weapon and conversely increasing resistance when desired. The FAL trigger assembly is comprised of a trigger set in place in the receiver lower with pressure applied to the rear of the trigger with a spring-loaded fastener called the Return Spring Plunger. When the trigger is pulled, the posterior end of the trigger pivots causing a sear to rock and disengage from the engagement surface on the hammer and release the hammer. The hammer strikes the firing pin. The firing pin fires the cartridge. The Set Trigger attaches to the spring-loaded screw assembly. The Set Trigger is operated by a button adjacent the trigger that the user presses at the moment he wants to reduce resistance on the trigger. The resistance is lessened by the Set Trigger applying pressure to the back end of the Return Spring Plunger and spring.

The set trigger in no way interferes with the structure or operation of the safety as designed in the FAL rifle. This set trigger assembly may be used with other firearms having a trigger assembly comparable to the FAL rifle.

OBJECT AND ADVANTAGES OF THE INVENTION

It is the object of the invention to provide an adjustable Set Trigger for a FAL or similar rifle of the character described.

Another object is to provide a Set Trigger that can be easily assembled and disassembled to allow for cleaning of the rifle.

Another object is to provide a Set Trigger that operates with the existing trigger assembly except for the addition of structure allowing the user either to use the trigger as a standard trigger or for a user to use the set trigger to reduce the pressure required to fire the rifle.

Another object is to provide a device which selectively is capable of reducing resistance on the trigger at the time of firing while allowing the user to operate the weapon with one hand on the grip.

Another object is to provide a device selectively to reduce resistance on the trigger at any time prior to firing without removing the grip and thereby avoiding exposure of the trigger assembly to the elements or loss of trigger assembly parts.

Another object is to provide a device to reduce resistance on the trigger at any time prior to firing without need to replace either the spring or the screw in the trigger assembly.

Another object is to provide a device to increase resistance on the trigger after firing the rifle with the set trigger engaged so as to avoid unintended firing after use with the set trigger mechanism engaged.

These and other objects and advantages will become more apparent as this description proceeds, taken in conjunction with the accompanying drawings.

BRIEF DESCRIPTION OF THE DRAWINGS

In the drawings:

FIGS. 6*a*, 6*b*, and 6*c* show the top, side and bottom views, respectively, of the set trigger head.

FIGS. 7*a*, 7*b*, and 7*c* show the top, side and bottom views, respectively, of the set trigger strut.

FIGS. 8*a* and 8*b* show the top and side views of the roll pin.

FIGS. 9*a*, 9*b*, 9*c*, and 9*d* show the rear, bottom, top, and right side views, respectively, of the trigger cam lever.

FIGS. 10*a*, 10*b*, and 10*c* show the top, side and bottom views, respectively, of the return spring plunger.

FIGS. 11*a* and 11*b* show the side and bottom views, respectively, of the return spring plunger spring.

FIGS. 12*a*, 12*b*, and 12*c* show the top, side, and bottom side views of the cam follower.

FIG. 13 shows a side view of the set trigger assembly.

Figure 1:
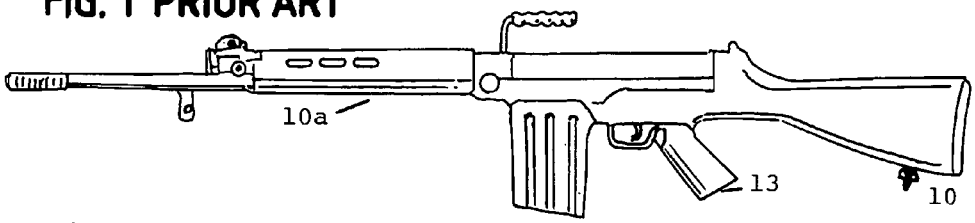
FIG. 1 PRIOR ART
FIG. 1 is a side elevation view of a FAL rifle.
Figure 2:
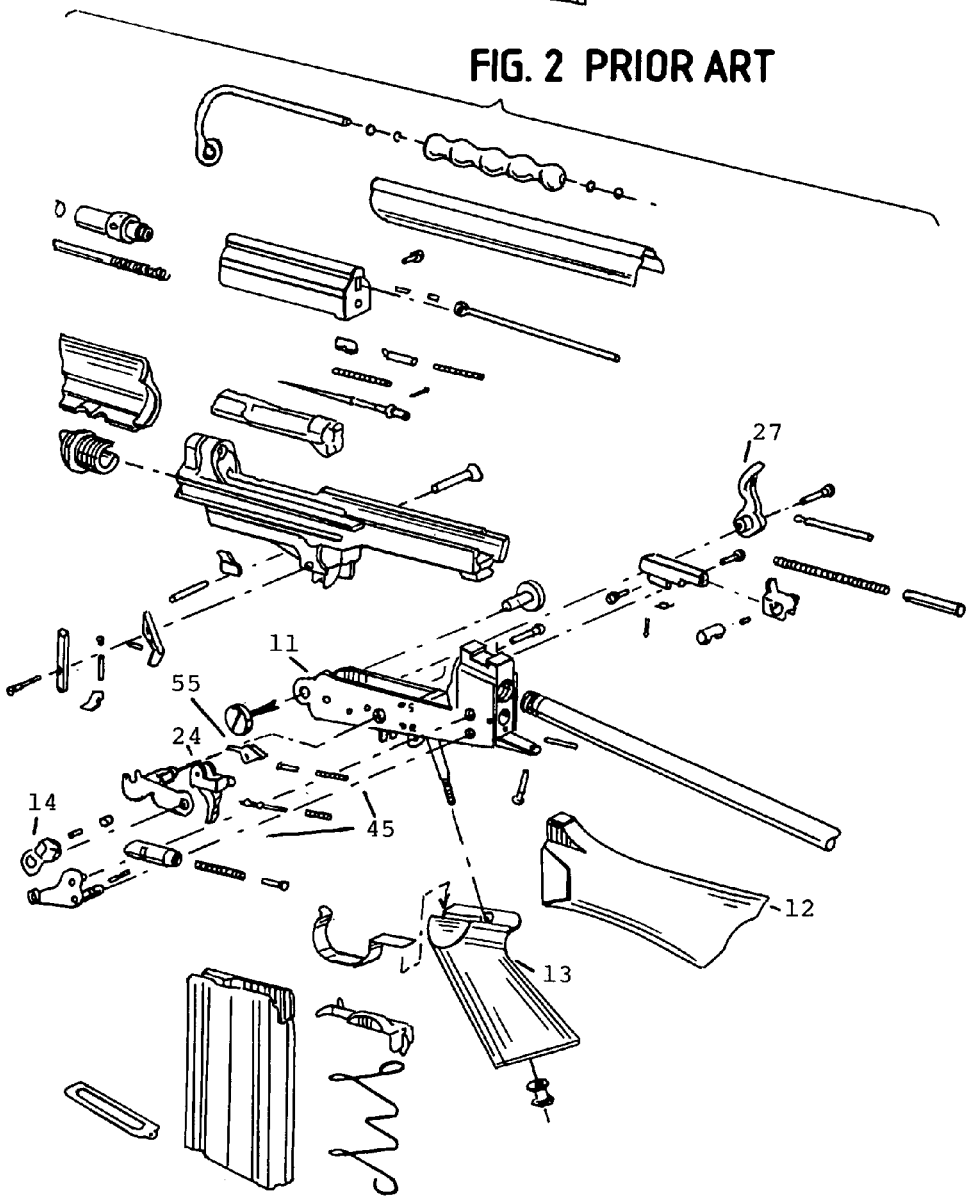
FIG. 2 PRIOR ART
FIG. 2 is a schematic of the components in a FAL rifle.
Figure 3:
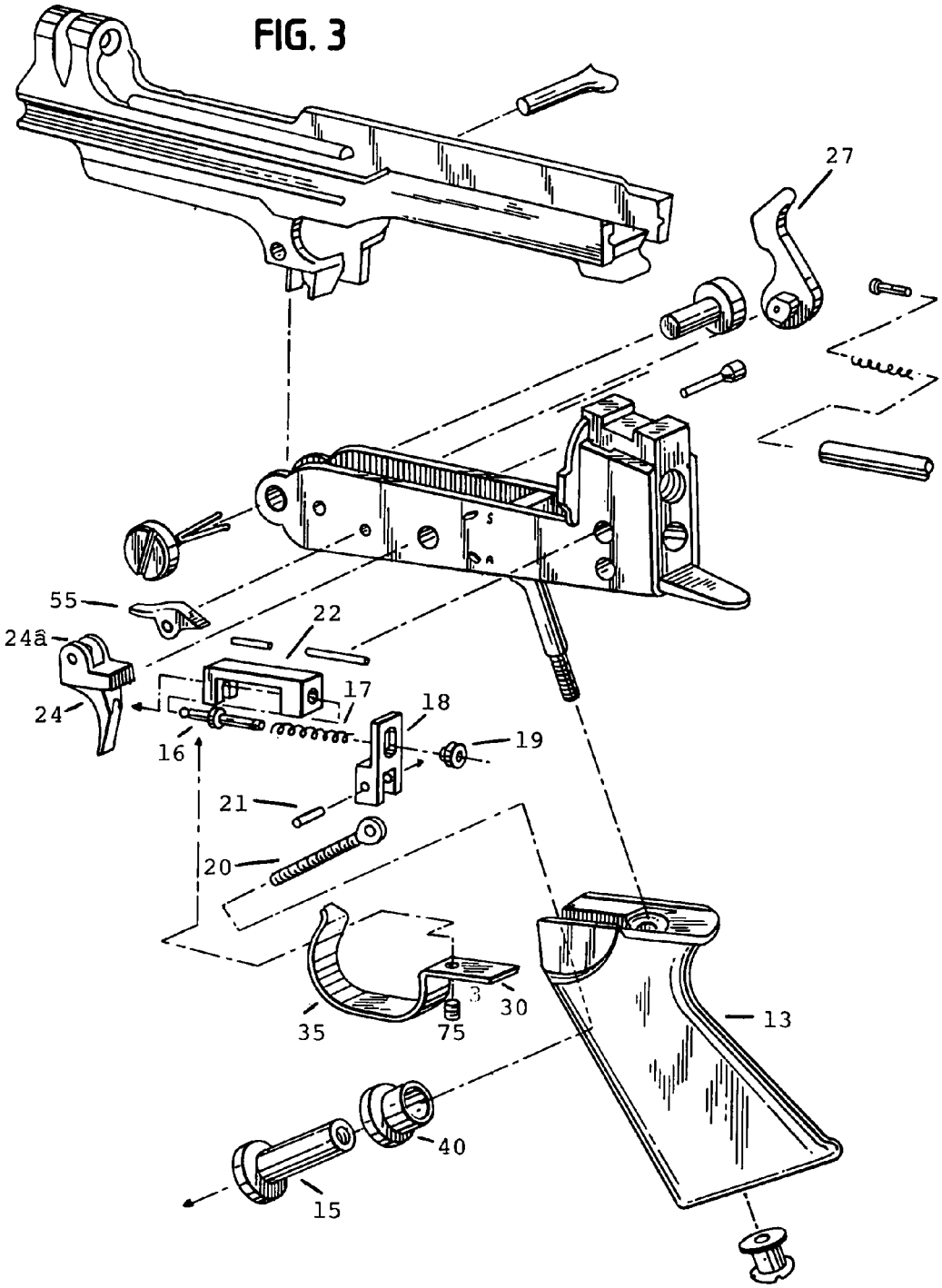
FIG. 3 is a side elevation view of the receiver lower, trigger, sear, hammer, and grip of a firearm like the firearm shown in FIG. 1 including the trigger assembly and additionally including the set trigger assembly.
Figure 4A:
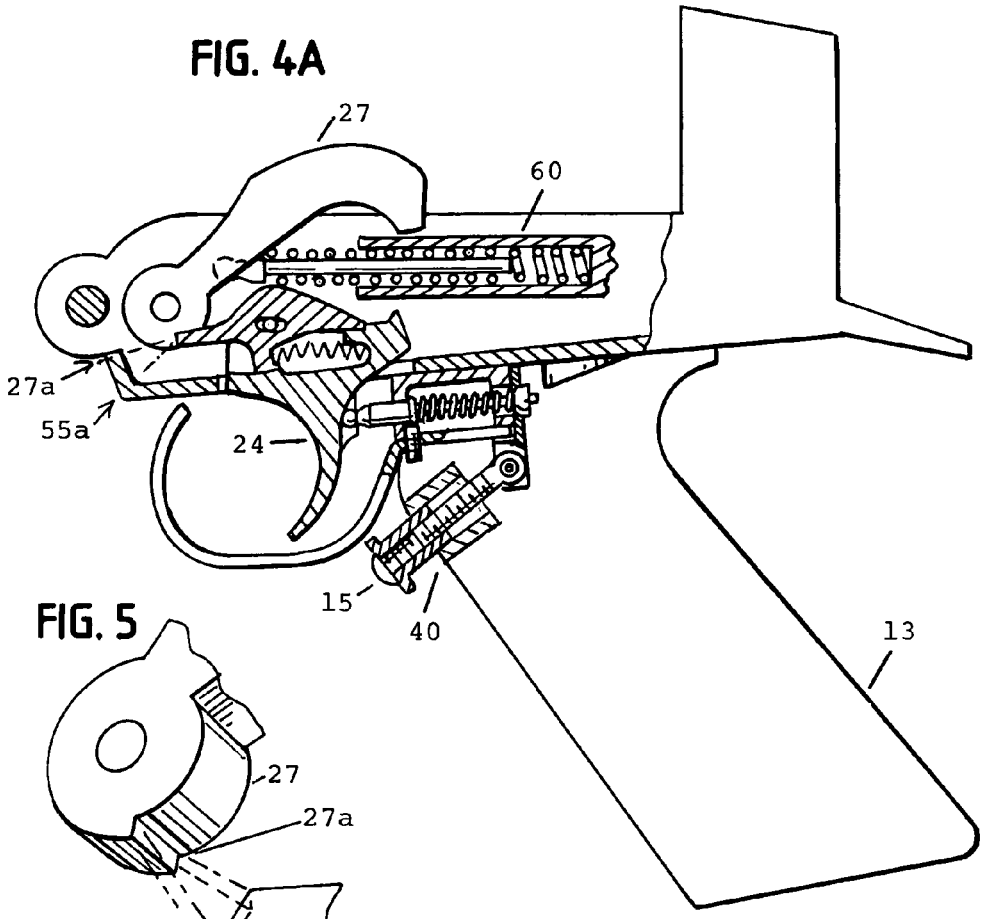
FIG. 4*a* is a side elevation view of the receiver lower, grip and hammer including a sectional view of the trigger, sear, hammer spring, trigger assembly, and set trigger assembly.
Figure 5:
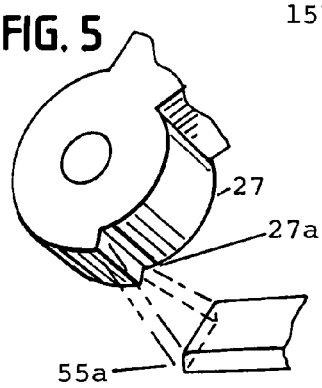
FIG. 5 is an exploded view of the hammer and its engagement surface and the sear and its sear nose.
Figure 4B:
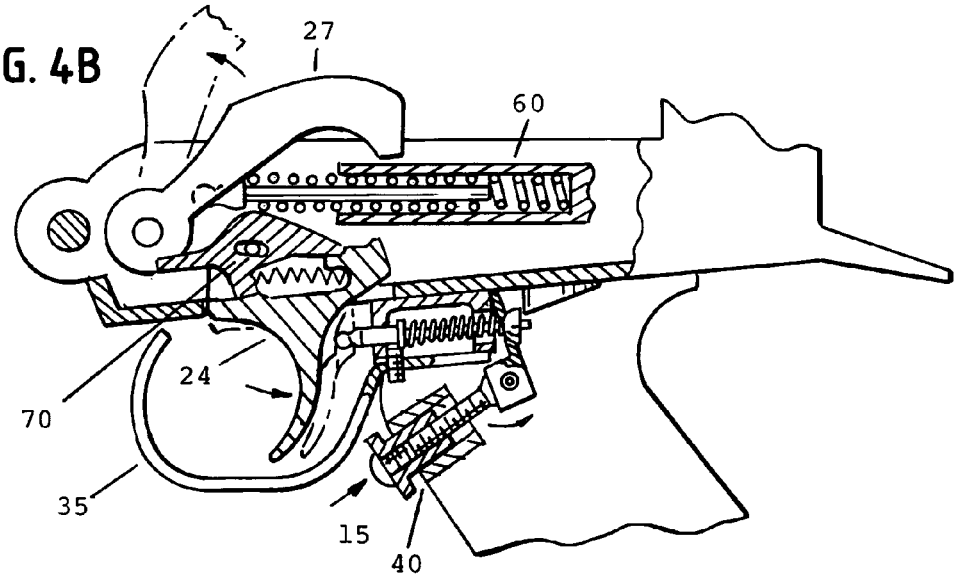
FIG. 4*b* is a side elevation view of the receiver lower, grip and hammer including a sectional view of the trigger, sear, hammer spring, trigger assembly, and set trigger assembly showing with arrows the action of the trigger, set trigger head, set trigger strut, trigger cam lever, roll pin, set trigger plunger, cam follower, and hammer.

3 is a side elevation schematic view of the receiver lower showing the Set Trigger assembly attached to the trigger assembly with dotted lines to show the Set Trigger when depressed.

DESCRIPTION OF A PREFERRED EMBODIMENT

With reference to the accompanying drawings, the set trigger assembly 50 embodying the present invention is found in the grip 13 of the FAL rifle 10 as shown. The entire rifle 10 has a the receiver lower 11. The receiver lower 11 is attached to the butt 12. In the receiver lower 11 there is a safety lever 14, housed in the receiver lower 11 and the trigger 24 and the grip 13. Housed within the grip 13 is the trigger assembly 45 and the set trigger assembly 50, to be described hereafter. The trigger assembly 45 is made up of the trigger 24 and resisting the trigger is the screw or return spring plunger 16 that is mounted with the spring or return spring plunger spring 17. The plunger 16 going through the spring 17 is mounted to the receiver lower 11 through the bracket or return spring plunger guide 22. This set trigger assembly 50 attaches to the trigger assembly 45 at the rear of the plunger 16. The plunger 16 fits through the set trigger attaching plate or trigger cam lever 18. At the other end of the lever 18, the set trigger shaft or set trigger strut 20 attaches to the lever 18 with the set pin or roll pin 21. The strut 20 is threaded. At the end of the strut 20 farthest from the lever 18 the Set Trigger head 15 threads on to strut 20. An aperture or hole 23 is created in the forward edge of grip 13 which allows the strut 20 to fit through the aperture 23. The head 15 is screwed onto the strut 20 from the outside of the grip 13 so as to hold the set trigger assembly 50 in place. The arrangement of the head 15 attached through the aperture 23 in the grip 13 allows the user to depress the head 15 with other than the index finger, as the index finger is typically used to pull the trigger 24.

The operation of this set trigger assembly in its preferred embodiment is as follows. The set trigger assembly 50 may be added on to the trigger assembly 45 of the rifle 10. If the user wants to use the rifle 10 without use of the set trigger assembly 50, then the user need only pull the trigger 24 without application of force to the head 15. In a normal rifle operation, the user holds the rifle 10 with one hand supporting the barrel 10*a* and the other hand on the grip 13. The user then places the index finger in the trigger guard loop 35 resting on the trigger 24. Safe practice dictates that the user does not disengage the safety lock lever 14 until just before the user wants to enter the firing sequence. On a FAL rifle 10 the safety lock is on the right side of the receiver lower 11. The user would pivot the safety lever 14 from the safe position "S" to the firing position "R". The receiver lower 11 has an aperture 65 on the right side (not shown) and left side to accommodate the safety. To seat the safety 14 in the receiver lower 11 one would set the safety in the aperture from the right side. The right side aperture is larger than the left side aperture. The part of the safety 14 that is placed through the receiver lower 11 is cylindrical in shape. The diameter of the end of the cylinder is smaller that the center of the safety 14 and of a size to fit into the aperture on the left side of the receiver lower 11. The cylindrical center of the safety has an area carved out of it. Adjacent to the safety 14 is the seating position for the trigger 24. The receiver lower 11 has a rectangular cut out to accommodate the trigger 24. A sear 55 sits in a slot in the top of the trigger 24. The sear 55 is seated with a post and spring applying force from the bottom of the slot at the rear of trigger 24. The sear 55 has an elliptical aperture through its side to allow for the insertion of a set pin that runs from the receiver lower 11 through the left side of trigger 24 through sear 55 through the right side of trigger 24 and through the right side of receiver lower 11. The sear 55 when looked at from the side tappers down from the center to the sear nose 55*a* and sear rear 55*b*. When the rifle is in firing position, the hammer 27 has an engagement surface 27*a* that is held in place by the sear nose 55*a* into the receiver lower 11. In original issue FAL steel parts, the parts are coated with an anti-reflective material. Being made of steel, the sear 55 and hammer 27 are both coated with this anti-reflective coating. Typically the sear nose 55*a* is flat and it catches the end of the engagement surface 27*a* on the hammer 27. In moving into firing position, the hammer 27 is retracted rearward into the receiver lower 11 and in doing so hammer spring 60 is compressed. In firing, the user pulls the trigger 24 driving up the back of the trigger 24 and the sear rear 55*b* causing disengagement of the hammer 27 at engagement surface 27 from sear nose 55*a*. With the standard sear, the hammer 27 must move rearward to disengage from the sear nose 55*a*. To move the hammer 27 to move rearward, the hammer spring 60 must be further compressed. In the preferred embodiment, the anti-reflective coating is removed from the engagement surface 27*a* of the hammer 27 and the sear nose 55*a* by grinding. Also, the preferred embodiment calls for removing part of the sear nose 55*a*. Specifically, in the preferred embodiment seven degrees of steel is removed from the top front of the sear nose by grinding. The trigger 24 and sear 55 are held in place by a set pin that fits through an aperture in the right wall of the receiver lower 11, then travels through the right wall of the trigger 24 and then the sear 55 and then the left wall of the trigger 24 and then through an aperture in the left wall of the receiver lower 11. When the user pulls the trigger 24, the trigger pivots partially and the rear surface of the trigger pushes up the sear rear 55*b*. That pivoting of the sear 55 releases the engagement surface of the hammer 27 allowing the hammer 27 to pivot forward to strike the firing pin and fire the rifle. On the posterior end of the trigger 24 is a protrusion. When the safety lever 14 is set on the safe position "S", the diameter of the cylindrical safety blocks the trigger 24 and sear 55 from pivoting sufficiently for the sear to disengage from the engagement surface. When the safety lever 14 is set in the off position then the protrusion on the trigger 24 can move through the vacant space on the safety cylinder allowing the trigger 24 to move and in turn the sear 55 sufficiently to disengage from the engagement surface 27*a* on the hammer 27. At the moment of firing the user pulls the trigger 24 rearward toward the posterior of the trigger guard loop 35. When the user pulls back the trigger 24, the user works against the plunger 16.

The set trigger assembly 50 does not change the trigger 24 or the manner in which the rifle 10 is fired. A lever 18 called is added to the posterior end of the plunger 16. When the rifle is held so that the receiver lower 11 is parallel and toward the ground, the end of the plunger 18 is held in a bracket 22 on the bottom of the receiver lower 11 just behind the trigger 24. The plunger 16 travels up the center of the spring 17. In the lever 18 is a concavity 18*a*. The plunger 16 is held in place at the forward end by a the forward end of the bracket 22.

In the preferred embodiment, a set screw 75 on the trigger guard tang 30 rests adjacent the plunger 16. When the set trigger assembly 50 is actuated, the force applied to the posterior of the plunger 16 applies force to the front of the plunger 16 so the set screw 75 added to the tang 30 keeps the plunger 16 in its path within the bracket 22. The lever 18 has an aperture 18*a* and a concavity on its rear side that responds to the cam follower 19 that screws onto the plunger 16 just to the rear of the posterior end of the bracket 22. In the preferred embodiment, the cam follower 19 nests in the concavity of lever 18 for better cooperation. Attached to the lever 18 is a strut 20. The lever 18 is connected to the strut 20 with a roll pin 29. The strut 20 travels from the lever 18 down and forward toward an aperture 23 in grip 13 below the trigger guard loop 35. Although not required, the preferred embodiment includes a self-lubricating bushing 40. In the preferred embodiment a head 15 screws onto the strut 20. In the firing of the rifle using the set trigger assembly, the user would typically have his or her index finger on the trigger 24 and his or middle finger on the head 15. When the user presses the head 15 towards the grip 13, force is applied to the lever 18 via the strut 20. The force drives backward and up and rocks the lever 18 retracting the plunger 16 and spring 17 and thereby reducing pressure inhibiting drawing back of trigger 24. In the preferred embodiment, the head 15 and strut 20 are threaded so that the head mounts on the strut. The user can lengthen the combined length of the head 15 and the strut 20 by unscrewing head 15 so that it protrudes farther through aperture 23 of grip 13 and the bushing 40. The farther the user presses the head 15 toward the grip 13, the more the lever 18 is forced to pivot rearward pushing rearward the plunger 16 and spring 17 thereby reducing more pressure from the trigger 24. The user may pull the trigger 24 and fire the rifle at any point while pressing in or letting out the head 15. The user may elect how to adjust the head 15 and strut 20 to achieve an optimal result for the user. The pressure on the trigger 24 drops and increases as the head 15 is forced toward the grip 13 and increases as force on the head 15 is reduced. In the preferred embodiment, when no force is applied to the head 15, the spring 17 and plunger 16 force the lever 18 to a position parallel to the rear side bracket 22, the head 15 and strut 20 automatically return to the standard FAL trigger firing position. In the preferred embodiment, the lever 18 is mounted to said plunger 16 such that the thick part of the lever 18 rides over and assists in keeping the tang 30 in connection with the bottom terminus of bracket 22 thereby assisting in keeping the plunger 16 in its path.

The disclosed set trigger assembly can be used with any trigger assembly having a spring loaded trigger similar to that on the FAL rifle.

While a preferred embodiment of the present invention has been disclosed and described in considerable detail, it should be understood that many modifications and changes may be made in the structure disclosed without departing from the spirit or scope of the invention.

We claim:

1. A set trigger assembly for a firearm with user control of the force applied on-demand to a trigger by selectively retracting and returning plunger from and to an initial position, said set trigger assembly comprising:

a lever assembly associated with said plunger, said lever assembly having means to control movement of said lever assembly away from said trigger and to move said plunger toward said trigger upon relaxing of said lever assembly, a receiver lower, said received lower having therein a return spring plunger spring, a cam lever in said lever assembly, bracketing means to fasten said plunger and said spring in said receiver lower so that said plunger and said spring exerts force on said trigger, and means securing said cam lever to said plunger, wherein said control means further comprises:

a set trigger strut, said cam lever and said strut being held together with securing pivotable means so that said cam lever and said strut rock when force is applied by the user said control means further comprising a grip on said receiver lower, said grip having mounting means on its forward edge to receive said lever assembly.

2. A set trigger assembly as claimed in claim 1, said control means further comprises:

a grip on said receiver lower, said grip having mounting means on its forward edge to receive said lever assembly.

3. A set trigger as claimed in claim 2, wherein said control means further comprises:

a set trigger head, said head being connected to said strut.

4. A set trigger assembly as claimed in claim 3, wherein said connection means is adjustable.

5. A set trigger assembly as claimed in claim 4, wherein said adjustable connection means comprises:

means on said head and strut for lengthening or shortening the combined length of said head and strut.

6. A set trigger assembly as claimed in claim 5, wherein movement of said adjustable connection means corresponds to pressure applied to said trigger when said set trigger head is arranged onto said strut.

7. A set trigger assembly as claimed in claim 5, wherein said head is threaded into said strut.

8. A set trigger assembly as claimed in claim 1, said control means further comprises:

guide means for said strut to guide said strut toward said lever as the user applies force to said set trigger assembly.

9. A set trigger as claimed in claim 8, said guide means further comprises:

a bushing mounted in said grip, said bushing having a diameter sufficient to guide said strut toward said grip as the user applies force to said set trigger assembly.

10. A set trigger as claimed in claim 9, in which said bushing is self-lubricating.

11. A set trigger assembly as claimed in claim 1, wherein said assembly includes a cam follower, and a concave recess is bored into said trigger cam lever so that said trigger cam lever may cooperate with said cam follower.

12. A method for reducing and returning to the initial level pressure required to fire a semi-automatic or automatic firearm equipped with a trigger, a return spring plunger, and a return spring plunger spring which comprises the steps of:

installing on a semi-automatic or automatic firearm equipped with a trigger and a return spring plunger a lever to associate said lever with said plunger along with means for the user to apply force to said lever to move said plunger away from said trigger and relieving force on said level such that said plunger returns to its initial position wherein said firearm has a sear and engagement surface for a hammer, said method further comprising the step of:

removing any existing coating from the engagement surface of the hammer and the sear nose, removing material from the top edge of the sear nose such that the resulting sear nose has an angle sufficient to allow the engagement surface of the hammer to disengage from the sear nose without further compressing the hammer spring.

13. A method as claimed in claim 12, wherein said firearm has a sear and engagement surface for a hammer, said method further comprising the step of:

removing material from the top of the sear nose to achieve a seven degree angle across the front of the sear nose.

14. A set trigger assembly associated with a trigger and adapted for installation into a receiver lower of a FAL rifle comprising:

a grip having a forward edge with an aperture, a self-lubricating bushing mounted in said aperture, a set trigger head having a diameter to accommodate said bushing, a set trigger plunger strut adjustably engaging said head, said strut having a flat end with an aperture therethrough, a trigger cam lever having a base and front and rear sides, a notch on said base from side to side, said base having an aperture therethrough, a lever, said strut flat end being connected to said lever by a roll pin, one side of said lever being abutted to a return spring plunger guide, said guide passing through an aperture in said lever and held in place by a cam follower affixed to said plunger, a return spring plunger spring mounted around said plunger between bracketing means on said receiver lower so that said plunger exerts force on the rear of said trigger, a trigger guard loop mounted with securing means forward of said trigger, and looping around said trigger, said guard loop having tang substantially parallel to said receiver lower said tang secured at its posterior end by said grip, whereby force applied to said strut exerts resistance to said trigger.

* * * * *